United States Patent [19]

Kidon et al.

[11] 4,273,628

[45] Jun. 16, 1981

[54] PRODUCTION OF CHROMIC ACID USING TWO-COMPARTMENT AND THREE-COMPARTMENT CELLS

[75] Inventors: William E. Kidon, Chardon; Nicholas Shuster, Perry; Andrew D. Babinsky, Chagrin Falls, all of Ohio

[73] Assignee: Diamond Shamrock Corp., Dallas, Tex.

[21] Appl. No.: 43,377

[22] Filed: May 29, 1979

[51] Int. Cl.[3] ..... C25B 1/14; C25B 1/22

[52] U.S. Cl. ..... 204/87; 204/97; 204/98; 204/128; 204/89

[58] Field of Search ..... 204/89, 97, 130, 87, 204/98, 128

[56] References Cited

U.S. PATENT DOCUMENTS

| | | | |
|---|---|---|---|
| 2,081,787 | 5/1937 | Boss . | |
| 3,222,267 | 12/1965 | Tirrell et al. | 204/98 |
| 3,305,463 | 2/1967 | Carlin | 204/98 |
| 3,841,851 | 12/1969 | Lancy | 204/97 |
| 3,909,381 | 9/1975 | Ehrsam | 204/130 |

FOREIGN PATENT DOCUMENTS

| | | |
|---|---|---|
| 739447 | 7/1966 | Canada . |
| 52-140768 | 5/1977 | Japan . |

*Primary Examiner*—R. L. Andrews

*Attorney, Agent, or Firm*—John J. Freer

[57] ABSTRACT

Chromic acid is now produced in simplified processing that also reduces acid contaminants, while using the alkali metal chromate typically available at an early stage in chromic acid production from chrome ore. In the process, chromate is converted to dichromate in the anode compartment of either a two-compartment, or three-compartment, electrolytic cell. During electrolysis, metal ion contamination is reduced. Withdrawn anolyte from this first cell may then be concentrated. The dichromate feed, possibly concentrated, is then introduced to the center compartment of a three-compartment electrolytic cell and flows through a porous diaphragm to the anode compartment of the cell. The anolyte from this later electrolytic cell, rich in chromic acid, can be concentrated, cooled, and the chromic acid recovered. Liquid removed from chromic acid recovery can be recycled. Alkali product is produced in the cathode compartment of each cell.

37 Claims, 2 Drawing Figures

PRODUCTION OF CHROMIC ACID USING TWO-COMPARTMENT AND THREE-COMPARTMENT CELLS

BACKGROUND OF THE INVENTION

The alkali roasting of chrome ore will provide a product that when leached with water yields an aqueous alkaline solution containing alkali metal chromate. This solution can then be reacted with acid to yield the dichromate. Sulfuric is a useful acid and a process employing same has been taught in U.S. Pat. No. 2,612,435. Carbon dioxide is also useful, and a showing of its use has been made in U.S. Pat. No. 2,931,704. Alternatively, as taught in U.S. Pat. No. 3,305,463, the sodium dichromate can be prepared in the anode compartment of a two-compartment cell. But, the dichromate must still be converted before commercial acid is prepared, and if typical acid processing is used, the overall process is inefficient.

It has not been unusual for the roasting of the ore to introduce chloride ions which contaminate the aqueous solution as sodium chloride. In order to remove this sodium chloride impurity, it has been taught in U.S. Pat. No. 3,454,478 that the major processing steps can be supplemented with a two-compartment electrolytic cell. This cell will be located along side the processing stream, and before the sodium dichromate crystallizer. The cell can be fed a small bleed stream that is electrolyzed, thereby removing the chloride as chlorine gas at the anode, and the dichromate liquor from the anode compartment of the cell is returned to the main process stream.

In U.S. Pat. No. 2,099,658, chromic acid is electrolytically produced using a sacrificial anode. In the process itself, however, a contaminated product can be produced. Otherwise, an ostensibly cumbersome and inefficient step-wise procedure is followed in attempting to achieve a more impurity-free acid.

It has also been taught, as in Canadian Pat. No. 739,447, that sodium dichromate can be fed directly to the anode compartment of a two-compartment cell in the process of preparing chromic acid. The efficiency of such operation, however, has not proven satisfactory.

Thus, in commercial production of the chromic acid, no cell utilization has been feasible. It would be desirable to efficiently prepare the acid using electrolytic cell processing.

SUMMARY OF THE INVENTION

It has now been found that alkali metal chromate can be effectively processed to prepare chromic acid, wherein the process uses electrolytic cells having highly desirable current efficiency. Further, the process offers effective reduction during electrolysis of metal ion contamination found when the chromate is produced from chrome ore. The cells are located in the mainstream of the invention process and, thus, initially utilize the alkali chromate feed that is available in traditional chromic acid production processes.

There is now further disclosed the most efficient utilization of alkali metal dichromate by recycling depleted cell feed and recycling of crystallization mother liquor for enhanced chromic acid production. The overall process provides for a reduction in processing equipment as well as a desirable reduction in by-product and by-product streams. Thus, a particular highlight of the process of the present invention is pollution reduction.

In its broadest scope, the invention is involved in the production of chromic acid from chrome ore wherein the ore is roasted, solids are removed, and processing provides alkali metal chromate. Within this broad scope, the invention involves the improvement in the chromic acid production which comprises: (A) introducing contaminated alkali metal chromate to the entry compartment of an electrolytic cell, such chromate containing reduced forms of chromium, if such exist, at substantially below about 2 percent of the chromate hexavalent chromium, the cell having substantially hydraulically impermeable cation-exchange membrane means separating the entry compartment from a cathode compartment; (B) introducing electrolyte to the cathode compartment; (C) attracting metal ion contaminants to the cation-exchange membrane of the cell while concomitantly preparing alkali metal dichromate solution in the anode compartment of the cell by applying electrolyzing current to the cell; (D) withdrawing from the cathode compartment electrolyzed catholyte solution containing alkali product; (E) withdrawing from the cell alkali metal dichromate solution of substantially reduced metal ion impurities; and (F) passing the dichromate solution to downstream processing for subsequent production of chromic acid.

In regard to such chromic acid production, an embodiment of the invention involves: (G) introducing alkali metal dichromate solution to a center compartment of a three-compartment electrolytic cell, the center compartment having porous diaphragm means separating same from an anode compartment, and further having substantially hydraulically impermeable cation-exchange membrane means separating the center compartment from the cathode compartment; (H) permitting center compartment solution flow throughout the porous diaphragm to the anode compartment; (I) introducing electrolyte to the cathode compartment of the three-compartment cell; (J) applying electrolyzing current to the three-compartment electrolytic cell; (K) withdrawing electrolyzed catholyte solution containing alkali product from the cathode compartment of the three-compartment cell; and (L) withdrawing electrolyzed anolyte solution containing chromic acid from the anode compartment for downstream chromic acid recovery.

In other aspects, the invention comprises establishing the presence of carbon dioxide in the cathode compartment, or to circulating catholyte, of one or both of the cells thereby preparing carbonate product in the catholyte. When metal ion impurities are successfully scavenged in, for example, a sacrificial membrane of the initial electrolytic cell, this thereby not only provides enhanced product purity but also yields extends performance for the subsequent three-compartment cell.

As used herein, the term "alkali product" refers to alkali metal hydroxide and/or carbonate product, any of which may be in solution. The term "carbonate product" refers to alkali metal carbonate and/or bicarbonate. It is contemplated that the alkali metal will most typically be sodium and/or potassium. Where "sodium" is mentioned herein, it is to be understood that "alkali metal" is contemplated; but, for overall economy, the sodium will be preferred. Also as used herein, the term "solution" is contemplated to include a slurry and/or the supplemental addition of solid product where such would be apparent to those skilled in the art. For example, dichromate solution feeding to the center compartment of the three-compartment electrolytic cell may be in slurry form. Also, this solution or slurry may be supplemented as, for example, to occasionally boost dichromate concentration, with the addition of solid dichromate.

DESCRIPTION OF THE PREFERRED EMBODIMENTS

Figure 1:
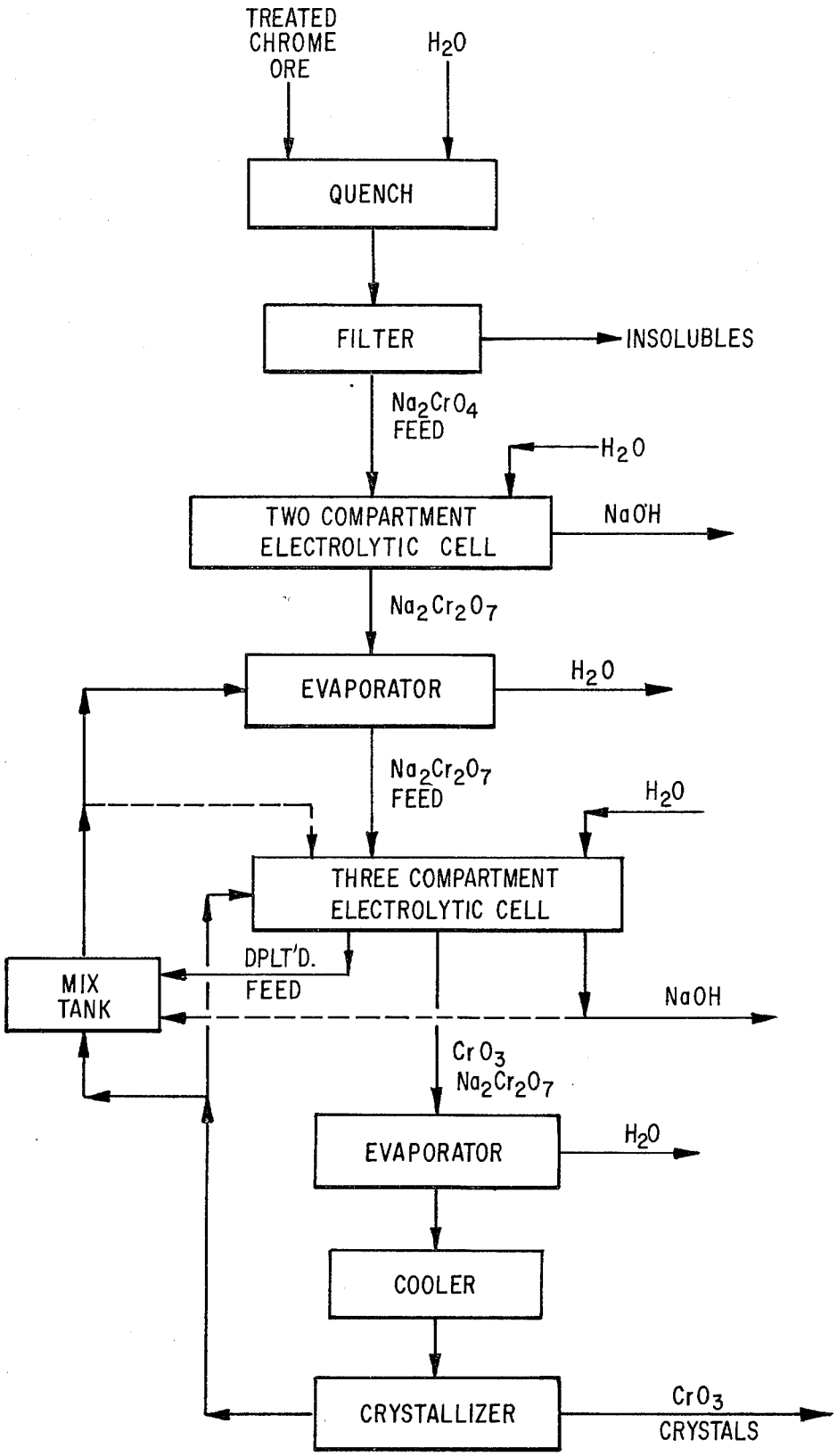
FIG. 1 is a flow sheet of one embodiment of a processing operation for preparing chromic acid wherein alkali metal chromate is introduced into the processing and whereby other methods of the present invention are employed.

In a process for preparing chromic acid in accordance with the present invention, a system can be used such as shown in FIG. 1. Referring to FIG. 1, the roasted chrome ore is contacted with water for quenching and leaching to recover soluble chromate salts. Following filtration to remove insoluble materials, an aqueous solution is obtained which is typically at a temperature within the range from about 15° C. to about 95° C. This solution contains alkali metal chromate along with some impurities and is generally quite dilute. The impurities can include metal ion contamination as well as processing by-products such as sulfate and/or carbonate salts.

Desirable concentration of this solution and contaminant removal may be accomplished in several ways, as discussed hereinbelow, or by using combinations of these procedures, as will be apparent to those skilled in the art. In one process, the dilute solution can be passed directly to an evaporator. Some pH adjustment can be desirable at this point, along with the resulting concentration in the evaporator. Thus, contaminant removal, e.g., by filtration and including sulfate and/or carbonate salts removal, is at least substantially accomplished prior to any electrolysis. It is desirable to obtain pH adjustment with sodium dichromate, which can be recycled back for such purpose from downstream operation, and/or for the first cell itself to supply pH adjustment. Following the first cell, processing by-products can be at least partially removed during subsequent product concentration, i.e., downstream from the cell. This downstream concentration can be with or without further pH adjustment.

Figure 2:
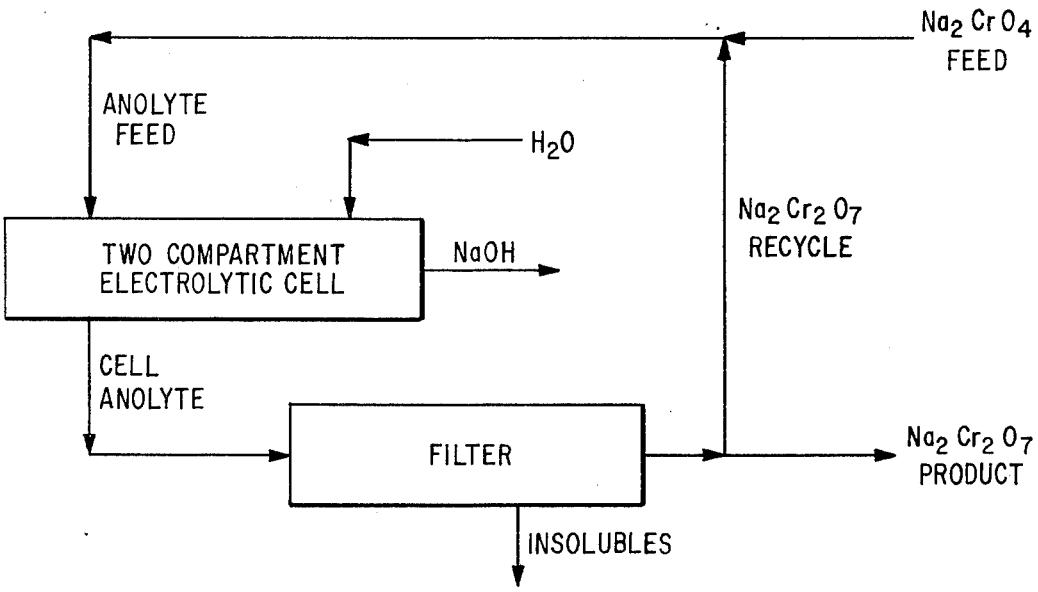
FIG. 2 is a flow sheet showing, as a portion of the overall processing operation, an embodiment for contaminant removal.

It is also contemplated, and referring to FIG. 2 for the moment, that this downstream contaminant removal take the dichromate-containing anolyte effluent from the first electrolytic cell, e.g., the anolyte from a two-compartment cell, and pass this through a filtration step for impurity removal, such as the removal of processing by-products. Thereafter, the filtered effluent can be at least partially recycled back to the first cell feed. A product bleed coming from the recycle line will feed alkali metal dichromate solution to an evaporator, or directly to the downstream three-compartment electrolytic cell.

Whether feeding from an evaporator or from a filter, or both, and referring again to FIG. 1, chromate feed enters the anode compartment of a two-compartment cell having a substantially hydraulically impermeable cation-exchange membrane separating the anode and the cathode compartment. The feed can contain minor amounts and is preferably feed from reduced forms of chromium, as will be detailed hereinafter in conjunction with the feed for the three-compartment cell. As is also discussed more particularly hereinbelow in conjunction with the three-compartment cell, aqueous electrolyte is introduced to the cathode compartment of the cell. Alkali product is withdrawn from such cathode compartment. From the anolyte compartment of the two-compartment cell, alkali metal dichromate solution may pass to an evaporator for concentration, as discussed hereinabove. For convenience, this evaporator will be termed the first evaporator, wherein water is removed. It is also contemplated that this first evaporator can be bypassed, e.g., intermittently, and dichromate solution fed directly to a three-compartment cell, especially if a concentrated and purified feed enters the two-compartment cell. The first evaporator can be any conventional apparatus for removing water from a solution but is, preferably, a tank equipped with a heater or vacuum means, or both, to facilitate water evaporation and consequent solution concentration in the tank. As mentioned hereinbefore, salts such as sulfate and/or carbonate salts formed by pH adjustment, may be removed from the system during this concentration stage.

From the first evaporator, as is shown in FIG. 1, or from the anolyte compartment of the two-compartment cell, alkali metal dichromate feed is passed to a three-compartment electrolytic cell. The dichromate solution enters the center compartment of the cell and will typically be at a temperature within the range from about 15° C. to about 95° C. Also, for augmented process efficiency, the feed will be more than about 30 weight percent, and preferably, for best efficiency, more than about 40 weight percent of alkali metal dichromate. Moreover, with sodium dichromate as an example, and with a feed solution temperature of about 85°–95° C., the weight percent of the sodium dichromate might be on the order of 70–90 weight percent. If reduced forms of chromium, e.g., trivalent chromium, are contained in the feed, i.e., if such exist in the feed, they should be present in an amount substantially below about 2 percent of the dichromate hexavalent chromium, which percentage is advantageously only a peak amount that is not sustained. The presence of reduced forms of chromium in the feed may lead to the formation of deleterious precipitates in the center compartment of the cell. Hence, if they exist in the feed at all, these reduced forms are advantageously present in an amount below about one percent of the dichromate hexavalent chromium. Preferably, for best ease of operation, the feed is free from reduced forms of chromium.

In typical cell operation, as will be discussed further hereinbelow, the feed to the center compartment will be substantially free from chromic acid. This assists in minimizing the presence of chromic acid in the center compartment. When no chromic acid is present in the center compartment electrolyte, the "anolyte ratio" of such compartment calculated for sodium dichromate is at 20.8 percent, and when calculated for potassium dichromate is at 31.95 percent. This ratio is defined as the alkali metal oxide concentration in the electrolyte divided by the sum of the electrolyte chromic acid concentration plus the alkali metal dichromate dihydrate concentration. The ratio is expressed as a percentage. All concentrations are in equivalent units, such as grams per liter, when calculating the ratio. For the case of sodium oxide, it is expressed as $Na_2O$.

In the cell, the center compartment solution flows through a porous diaphragm to an anode compartment. Referring again to FIG. 1, depleted solution from the center compartment can be returned to a mix tank. Alternatively, some or all of the depleted solution can be returned to the first evaporator, or directly back to join the incoming feed. Aqueous electrolyte is introduced into the cathode compartment of the cell. Although it is contemplated that this electrolyte might be no more than simply tap water, it is preferably primed at the outset of cell operation for enhanced cell efficiency at start-up. Alkali metal hydroxide is suitable for priming. Thereafter, during electrolysis, the alkali product concentration of the catholyte for either cell may be at least partially controlled by water addition, or such addition to recirculating catholyte, not shown, or by the addition of such dilute aqueous solution as can be provided by introducing carbon dioxide to the catholyte feed. Alkali product will be removed from the cathode compartment during continuous electrolysis. A portion of this alkali product may be circulated back to the mix tank for pH adjustment of the solution in the tank, or some may be recycled back for use in the chrome ore roasting process. Also, at least a portion of the alkali product from the two-compartment cell may be used in this manner, as by combination with the alkali product from the three-compartment cell.

In cell operation electrolyzing sodium dichromate, although the anolyte ratio for the anolyte will be below 20.8 percent, for ease in subsequent chromic acid crystallization, it is preferable to continue electrolysis until the ratio, for the anolyte, reaches a percentage down to at least on the order of about 11–13 percent. For most efficient overall operation, the electrolysis will not provide a ratio for the anolyte extending below about 3 percent. From the anolyte compartment of the electrolytic cell, the chromic acid solution, containing some alkali metal dichromate, and being at an elevated temperature from about 40° C. to about boiling, passes to a second evaporator, as will be seen by reference to FIG. 1. A conventional thin film evaporator, or a flash evaporator, or a multiple effect evaporator may be used, usually with heat application. The concentrated chromic acid is then cooled. Before cooling, the solution will generally be at a temperature within the range of from about 95° C. to about 150° C. under normal pressure, and the cooling operation will usually reduce the concentrated chromic acid solution to a temperature within the range from about 20° C. to about 60° C. The cooling means can be a cooling crystallizer, e.g., a stirred tank equipped with a cooling jacket. Therein, acid crystals form during cooling. On the basis of achieving a cooled solution having a temperature of about 25° C., the evaporator may remove up to about 85–95 weight percent of the solution water.

The cooled solution is then ready for crystal recovery. The crystal recovery means, e.g., a centrifuge, separates the chromic acid crystals from the mother liquor. This mother liquor, containing alkali metal dichromate and depleted of chromic acid, can then be circulated back to the mix tank. In this case, recirculating alkali product can be used to facilitate pH adjustment of the mix tank contents, typically to a pH within the range of 3–5 and, preferably, of about 4, for augmenting the dichromate content of the tank. After the dichromate content is thus enhanced, i.e., acid content is reduced and may be eliminated, the mix tank solution is then suitable for passing to the three-compartment cell center compartment. In this case, it can enter in combination with the evaporator feed to the center compartment, or the mix tank solution can be recirculated to the first evaporator. The mother liquor, or a portion thereof, can be passed back directly from the crystallizer to the anolyte compartment of the three-compartment electrolytic cell, since this mother liquor will contain chromic acid. For efficiency, any chromic acid entering this cell, e.g., in recycled solution, will come into the anode compartment. Advantageously, for efficient cell operation, any feed to the center compartment will thus be substantially free from chromic acid, e.g., contain a few weight percent at most of chromic acid. Preferably, for best efficiency, this feed is free from chromic acid. It is contemplated that the evaporation, cooling and crystallization can all be effected in a vacuum crystallizer, with the mother liquor therefrom being recirculated as above-described.

It is also contemplated that the alkali metal chromate can be electrolyzed in a three-compartment cell. Typically, in this process modification, the chromate enters the center compartment of the cell and flows through a porous diaphragm to the anode chamber. Aqueous electrolyte is fed to the cathode chamber. A cation-exchange membrane separates the catholyte from the center compartment and serves to scavenge metal ion impurities as does such membrane in a two-compartment cell. The dichromate-containing anolyte may then be fed to the first evaporator, for example. That is, such products from the three-compartment cell are passed on from the cell as discussed hereinbefore for the two-compartment cell. Cell operation, e.g., recycle of depleted center compartment solution, can be handled as described hereinabove for the three-compartment cell used to prepare chromic acid.

The electrolytic cells used in the invention process may be single cells or a plurality of cells, e.g., a plurality of two-compartment cells and a plurality of three-compartment cells, with each plurality being combined together into a single electrolyzing unit either in series using bipolar electrodes or in parallel.

Referring to a single cell unit for the two-compartment cell, the alkali metal chromate solution feeds to the anolyte compartment which compartment will be separated from the cathode compartment by a substantially hydraulically impermeable cation-exchange membrane. Such membranes will be more particularly discussed hereinbelow. During electrolysis, the membrane permits the movement of alkali metal ions into the cathode chamber while impeding movement across the membrane of chromate ions into the catholyte and of hydroxyl ions from the catholyte into the anolyte. When the chromate feed is contaminated with metallic ions, particularly those of calcium, aluminum, magnesium, and heavy metals, e.g., iron and vanadium, the membrane can serve to scavenge these ions from the feed solution, thereby enhancing the production of a more purified chromic acid product.

The anode compartment will be equipped with an inlet for introducing alkali metal chromate feed and will have an outlet for withdrawing alkali metal dichromate product solution. In addition to the product outlet, the anode compartment will have an outlet for removing oxygen gas evolved at the anode. This gas may, in part, be mixed with trace amounts of impurity, i.e., halide impurity. It is contemplated that such impurity will be chlorine gas as the cell feed may be contaminated with alkali metal chloride and the anode used may be one, such as those formed from valve metals having a noble-metal-containing coating that are discussed hereinbelow, which facilitate chlorine gas evolution. In such case, the cell further acts to retard the presence of impurities in the acid product. Useful anodes will be discussed more particularly hereinbelow. Likewise, useful cathodes for the cathode compartment will also be more particularly described hereinafter. The cathode compartment will be equipped with an electrolyte inlet line for introducing aqueous electrolyte thereto. During cell operation, the inlet line may be used for circulating electrolyte. It will preferably be used to prime the cell at start-up, as discussed hereinabove. The compartment will also have a product outlet line for removing, for example, sodium hydroxide from the cathode compartment. Further, the cathode compartment may be equipped with a line for introducing carbon dioxide into the cathode. When this is used, carbonate product will be removed from the product outlet line. The cathode compartment will also have a vent to permit escape of hydrogen gas generated at the cathode. Although operating direct current densities for the cell of between 0 and up to about 10 amperes per square inch are contemplated, a density within the range of about 1 to 4 asi is preferred for best efficiency.

Referring to a single cell unit for the three-compartment cell, the cell will, preferably, achieve a pressure differential between the center compartment and the anode compartment to enhance the flow of center compartment liquid into the anode compartment. This differential can be obtained by pumping the feed through the center compartment or by maintaining a hydrostatic head of cell solution in the center compartment. Achieved pressure on the center compartment of above 0 psig and of up to about one psig has been found to be suitable, while such up to about 2 psig is contemplated. All electrolytes can be at essentially atmospheric pressure. By this, it is meant that no additional pressure is contemplated other than resulting from cell operation, such as might be associated with the hydrostatic pressure of the center compartment, or with the addition of carbon dioxide to the catholyte, or the like. The center compartment will also be equipped with an outlet for passing depleted center compartment solution out of the cell, although cell feed can also be kept in balance with the flow of center compartment solution through the porous diaphragm to the anode compartment. This solution flow provides fresh feed for the anolyte, and the solution sweeping into the anolyte will retard migration of hydrogen ions from the anode compartment.

The porous diaphragm may be constructed of any material compatible with the alkali metal dichromate and chromic acid environment of the cell and which will also permit bulk hydraulic flow from the center compartment to the anolyte, as well as having appropriate electrical conductivity characteristics. An example of such material is asbestos. Of particular interest are diaphragms produced from fluorocarbon polymers, e.g., poly(fluorocarbons) which are copolymers of fluorocarbons and fluorinated sulfonyl vinyl ethers. The diaphragm may be in the form of a porous sheet of the poly(fluorocarbon) copolymer, or in the form of a porous base member having at least a portion of its surface coated with the copolymer. Suitable base members include poly(fluorocarbons) and asbestos. The porous or poromeric sheets or coated base members will usually be in the form of sheets having a thickness of less than 0.25 inch to optimize cell efficiency. The typical porosity for such materials may range from 15 to 85 percent, but is, preferably, below about 40 percent to retard backflow of anolyte solution to the center compartment. Individual pores may have areas on the order of from $8\times10^{-13}$ square centimeters to about $8\times10^{-5}$ square centimeters per pore when measured by the method described in ASTM Standard 02499. A description of these particular membranes has been made in West German Patent Publication No. 2,243,866. Other suitable diaphragm materials include acid resistant filter paper, ceramic, polyethylene, chlorofluorocarbon, poly(fluorocarbon) and other synthetic fabrics so long as they provide a relatively low electrical resistance. In this regard, electrolysis will be carried out with direct current at a current density between 0 and about 10 amperes per square inch. A density within the range of about 1–4 asi is preferred for best efficiency. The anode compartment will have, in addition to the product outlet, an outlet for removing oxygen gas evolved at the anode which may be in part mixed with trace amounts of impurity, as discussed hereinabove in connection with the two-compartment cell. The anode compartment may further have an inlet for admitting recycled solution, the feeding of which to the anode compartment has been mentioned hereinbefore.

The cathode compartment for the three-compartment cell can function in the same manner as the cathode compartment of the two-compartment cell. That is, the compartment will be provided with an electrolyte inlet, and possibly an inlet for introducing carbon dioxide to the cathode chamber if the production of other than alkali metal hydroxide is desired, as well as having a product outlet for the removal of catholyte solution, i.e., resulting alkali product, and an outlet for hydrogen gas escape. Suitable cathodes for the compartment have been discussed in greater detail hereinbelow. In cell operation, the movement of alkali metal ions into the cathode chamber will be permitted by the cell membrane, while the transport across the membrane of hydroxyl ions from the catholyte and dichromate ions from the center compartment into the catholyte, will be impeded. Suitable membranes for such use are discussed hereinbelow.

The anode used in the electrolytic cell of the invention process may be any conventional, electrically-conductive, electrocatalytically active material resistant to the anolyte such as the lead alloy types used commercially in plating operations. Lead and lead alloy anodes are preferred. Other useful anodes include those that are formed from a valve metal such as titanium, tantalum or alloys thereof bearing on its surface a noble metal, a noble metal oxide (either alone or in combination with a valve metal oxide), or other electrocatalytically active, corrosion-resistant material. Anodes of this class are called dimensionally stable anodes and are well-known and widely used in industry. See, for example, U.S. Pat. Nos. 3,117,023, 3,632,498, 3,840,443 and 3,846,273. While solid anodes may be used, foraminous anodes having about 25 percent or more of their surface area open, such as an expanded mesh sheet, woven mesh screen, or perforated plate, are preferred since they have greater electrocatalytic surface area and facilitate the flow of fluids in the anolyte compartment, e.g., facilitate the removal of oxygen gas from the compartment. In the three-compartment cell, the anode can be in juxtaposition with the diaphragm or laminated to the diaphragm.

The membrane used in any of the cells may be, in general, any hydraulically impermeable cation-exchange membrane electrolytically conductive in the hydrated state obtaining under cell operating conditions and compatible with the environment. These membranes may comprise a film of a polymer, chemically resistant to the feed solution and catholyte. When such structure is present, the film will, preferably, contain hydrophylic, ion-exchange groups such as sulfonic groups, carboxylic groups and/or sulfonamide groups. Membranes made from polymers containing sulfonic and/or carboxylic groups have been found to have good selectivity (that is, they transport virtually only alkali metal ions) and low-voltage characteristics for the production of alkali metal hydroxide, or carbonate or bicarbonate, in the catholyte, while membranes containing sulfonamide groups may be useful in obtaining higher caustic current efficiencies, but require a somewhat higher electrolyzing voltage. Typically, these membrane polymers have an ion-exchange group equivalent weight of about 800–1500 and the capacity to absorb, on a dry basis, in excess of 5 weight percent gel water.

The cation of the ion-exchange group (representative groups being $$-CO_2H,\ -SO_3H,\ -SO_2N\begin{matrix}R\\H\end{matrix}$$

and the like) in the membrane will mostly be alkali metal, i.e., the same alkali metal as present in the cell feed. While the acid or other alkali metal salt form can be employed at start-up, it will be appreciated that the membrane will exchange virtually all of these cations for the cation of the alkali metal of the cell feed within a relatively short period of cell operation. Polymers having all of their hydrogens replaced with fluorine atoms or the majority with fluorine atoms and the balance with chlorine atoms, and having the ion-exchange groups attached to a carbon atom having at least one fluorine atom connected thereto, are particularly preferred for maximum chemical resistance.

To minimize electrolyzing voltage, the membrane, preferably, has a thickness in the range of about 3 to 10 mils, with thicker membranes in this range being used for better durability. The membrane will typically be laminated to and impregnated into a hydraulically permeable, electrolytically nonconductive, inert reinforcing member such as a woven or nonwoven fabric made from fibers of asbestos, glass, poly(fluorocarbons) and the like. In film-fabric laminated membranes, it is preferred that the laminate have an unbroken surface of the film resin on both sides of the fabric to prevent leakage through the membrane caused by seepage along the fabric yarns. Such laminates and methods for their manufacture are disclosed in U.S. Pat. No. 3,770,567. Alternatively, films of the membrane polymer may be laminated to each side of the fabric.

Suitable membranes are available from the E. I. du-Pont de Nemours & Co. under the trademark NAFION. The preparation and description of suitable NAFION and other types of membranes is provided, among others, in British Pat. No. 1,184,321, German Patent Publication No. 1,941,847, U.S. Pat. Nos. 3,041,317, 3,282,875, 3,624,053, 3,784,399, 3,849,243, 3,909,378, 4,025,405, 4,080,270, and 4,101,395. By being "substantially hydraulically impermeable," as the term is used herein, these membranes under the broad ranges of cell operating conditions may be expected to afford virtually no transportation of cell electrolyte by direct flow through pores within the membrane structure.

The cathode used in the electrolysis cell of the invention process, may be any conventional electrically conductive material resistant to the catholyte, such as iron, mild steel, stainless steel, nickel, and the like. The cathode may be foraminous and gas permeable, e.g., having at least 25 percent of its surface area open, thereby facilitating the flow and removal of hydrogen gas in the catholyte compartment, and/or the circulation of carbon dioxide when such is introduced for production of carbonate or bicarbonate in the cathode chamber. To reduce the electrolyzing voltage, all or part of the surface of the cathode may bear a coating or layer of a material lowering the hydrogen overvoltage of the cathode, such as are disclosed in U.S. Pat. No. 4,024,044 (melt-sprayed and leached coating of particulate nickel and aluminum), U.S. Pat. No. 4,104,133 (electrodeposited coating of a nickel-zinc alloy), and U.S. Pat. No. 3,350,294 (coating of molybdenum and tungsten and cobalt, nickel or iron). Useful cathodes also include oxidizing gas depolarized cathodes. Such have been discussed, for example, in U.S. Pat. No. 4,121,992.

Suitable cathodes can be made from, for example, expanded mesh sheet, woven wire screen or perforated plates. The cathode may be a parallel-plate electrode, although other elongated electrode elements having other cross-sectional shapes, such as round, elipsoid, triangular, diamond, and square, can be utilized. The cathode can be in juxtaposition with the membrane or laminated to the membrane. Preferably, for best operating efficiency, nickel plated steel cathodes are used.

Although incoming cell electrolytes can be at room temperature, the cells will operate at elevated temperature, e.g., up to about boiling. Elevated temperatures result in increased solution conductivity and hence, lower cell voltages. Generally, the cells will be at a temperature above about 40° C. and advantageously will be at a temperature above about 60° C. Preferably, for most efficient conductivity, the cell electrolytes are at a temperature within the range from about 80° C. to about 95° C. In addition to the heat generated in the cells or contributed by incoming solution, the feed lines may be heated or a heater placed in the cells to provide additional heat input.

The following shows an illustrative embodiment of the invention wherein sodium chromate solution is fed to a two-compartment cell. The cell was of sufficient size to accommodate electrodes of 3 square inches in projected frontal surface area. The cell had an anode chamber constructed of glass and a cathode chamber constructed of acrylic plastic. These chambers are separated by a substantially hydraulically impermeable cation-exchange membrane which will be discussed more particularly hereinbelow in connection with the three-compartment cell. The membrane was sealed on the anode side as well as on the cathode side with a polytetrafluoroethylene gasket. The anode and cathode used are the same as described hereinbelow for the three-compartment cell. Outlet vents were provided for withdrawal of oxygen gas at the anode and hydrogen gas at the cathode. The anode compartment contained a heater.

An aqueous solution of sodium chromate that varied in concentration between 600 and about 1200 grams per liter of sodium chromate, plus a trace of sodium chloride and heavy metal impurities, was fed to the anode compartment of the cell. The temperature of this solution feeding into the cell was 20° C. Distilled water at a temperature of about 20° C. was introduced into the cathode compartment and for initiation of electrolysis, the compartment was primed with sodium hydroxide. A current of 6 amps was introduced to the cell providing a current density of 2 amps per square inch. The voltage drop in the cell was 4.5–5.0 volts.

The sodium chromate solution feeding to the anode compartment was sufficient to maintain a constant volume of anolyte solution. During cell operation, the pH of the anolyte was held to between about 3.0 to 4.0. From the cathode compartment, caustic solution containing about 200–400 grams per liter sodium hydroxide was removed, with the solution strength being controlled by the rate of water into the compartment. Anolyte solution, from the anolyte chamber, and being at a temperature varying between 70° and 90° C. was continuously withdrawn. This solution contained between about 500 and 1100 g/l sodium dichromate. From visual inspection of the membrane, it could be seen that metal ion impurities, as a white deposit, were scavenged by the membrane. It was also noted that the escaping oxygen gas sometimes contained chlorine gas.

The sodium dichromate leaving the anode compartment was passed to an evaporator. The evaporator was a round bottom flask equipped with a heating mantel and overhead condenser. The evaporator contents were kept at a temperature that varied from about 60° C. to about 100° C. and the evaporator was operated when it was desired to adjust the sodium dichromate concentration, which was often greater than 700 g/l. From the evaporator, sodium dichromate was fed to the center compartment of a three-compartment cell.

The cell was of sufficient size to accomodate electrodes of 3 square inches in projected frontal surface area. The cell had polytetrafluoroethylene gasketing between the center and cathode compartments, as well as between the center and anode compartments of the cell. Outlet vents were provided for passage of oxygen gas at the anode and hydrogen at the cathode. The center compartment was constructed of titanium.

The anode compartment of the electrolytic cell was constructed of glass and contained a circular anode having a surface area of 3 square inches. The anode used was an expanded mesh titanium metal anode bearing a tantalum oxide/iridium oxide coating. Such anodes have been disclosed in U.S. Pat. No. 3,878,083. The hydraulically permeable porous diaphragm separating the feed compartment from the anode compartment was an about 21 mils thick porous member of a perfluorosulfonic acid copolymer deposited on a polytetrafluoroethylene mesh substrate.

The cathode compartment was constructed of acrylic plastic. The cathode chamber contained an array of nickel parallel plate cathodes, designed to facilitate hydrogen gas release and provided a projected frontal surface area of 3 square inches. Separating this compartment and the feed compartment was a substantially hydraulically impermeable cation-exchange membrane. The membrane used was about a 14 mils thick film comprised of an integral layer of a copolymer laminated to a square-woven polytetrafluoroethylene fabric. The layer laminated to the fabric had a thickness of about 7 mils and comprised a copolymer having recurring units of:

$$-CF_2-CF_2-$$

and $$-CF_2-\underset{\underset{O-CF_2-\underset{\underset{CF_3}{|}}{CF}-O-CF_2-SO_3H}{|}}{CF}-$$

and an equivalent weight of about 1100.

A current of 6 amps was introduced to the cell by conventional means giving a current density of 2 amps per square inch. The voltage drop for the cell was about 6 volts at the cell temperature which was maintained at about 80° C., with supplemental heat being provided as needed by a heater in the anode compartment. A hydrostatic liquid head difference was maintained between the center and anode compartments. This created a pressure drop of less than 1 psig across the porous diaphragm and allowed bulk flow from the center to the anolyte compartment. The feed solution was entering the center compartment at a rate of approximately 3.5 milliliters/minute (ml/min). Into the cathode compartment distilled water at a temperature of about 20° C. was introduced at a rate sufficient to control the caustic strength of catholyte at between 150–400 g/l. Prior to the initiation of electrolysis, the compartment was primed with sodium hydroxide.

Depleted sodium dichromate solution was removed from a line at the top of the hydrostatic head of the center compartment. The flow rate for the depleted feed stream varied from zero ml/min to 3.5 ml/min. From the vent line at the top of the anode chamber, oxygen gas was vented off. From the vent line at the cathode chamber, hydrogen was removed. In leaving the cathode compartment, the caustic catholyte was withdrawn at a rate of about 0.3–0.5 ml/min. From the anolyte chamber, at a rate of 0.4–0.5 ml/min and a temperature of about 80° C., electrolyzed solution containing about 500–600 g/l chromic acid was withdrawn and introduced to an evaporator.

The evaporator was a round bottom flask equipped with a heating mantel and overhead condenser. The contents of the evaporator were slowly heated to a temperature of about 140° C. thereby providing a chromic acid concentration of about 57–62 percent, by weight. For cooling, the concentrated chromic acid was maintained in the flask and permitted to air cool to about 25° C. The water from the evaporator was removed from the system. Chromic acid crystallization was initiated in the flask.

The cooled and concentrated chromic acid mixture was then introduced to a solid-liquid separator. This was a basket centrifuge with a 5 inch diameter titanium basket and a glass cloth filter blanket, and it was operated at about 6100 rpm. The chromic acid crystals, having a $CrO_3$ content of about 97.5–98 weight percent, were then removed from the crystallizer for further treatment. The liquor removed from the crystallizer, having about 28 weight percent chromic acid content, was removed from the system.

What is claimed is:

1. In the process of producing chromic acid from chrome ore wherein the ore is roasted, solids are removed, and processing provides intermediate alkali metal chromate, the improvement which comprises:

(A) introducing alkali metal chromate to the anolyte compartment of a two-compartment electrolytic cell, said chromate containing reduced forms of chromium, if such exist, at substantially below about 2 percent of the dichromate hexavalent chromium, said cell having substantially hydraulically impermeable cation-exchange membrane means separating said anolyte compartment from a cathode compartment;

(B) introducing electrolyte to said cathode compartment;

(C) applying electrolyzing current to said two-compartment electrolytic cell;

(D) withdrawing from said cathode compartment electrolyzed catholyte solution containing alkali product;

(E) withdrawing from said anolyte compartment electrolyzed anolyte solution containing alkali metal dichromate;

(F) introducing alkali metal dichromate solution to the center compartment of a three-compartment electrolytic cell, said center compartment having porous diaphragm means separating same from an anode compartment and further having substantially hydraulically impermeable cation-exchange membrane means separating said center compartment from the cathode compartment;

(G) permitting center compartment solution flow through said porous diaphragm to the anode compartment;

(H) introducing electrolyte to the cathode compartment of the three-compartment cell;

(I) applying electrolyzing current to said three-compartment electrolytic cell;

(J) withdrawing electrolyzed catholyte solution containing alkali product from said cathode compartment of the three-compartment cell; and (K) withdrawing electrolyzed anolyte solution containing chromic acid from said anode compartment for downstream recovery of chromic acid.

2. The process of claim 1 further characterized by withdrawing cell solution, depleted in alkali metal dichromate, from the center compartment of said three-compartment cell and recycling same to combine with alkali metal dichromate feed introduced in step (F).

3. The process of claim 2 further characterized by passing at least a portion of said withdrawn cell solution to a mix tank.

4. The process of claim 3 wherein at least a portion of electrolyzed catholyte solution is fed to said mix tank.

5. The process of claim 3 further characterized by crystallizing chromic acid crystals, in the downstream recovery of chromic acid, and introducing chromic-acid-containing liquor separated from said crystals into said mix tank.

6. The process of claims 3, 4, or 5 wherein solution is withdrawn from said mix tank and introduced in step (F) to said three-compartment electrolytic cell.

7. The process of claim 1 wherein for each electrolytic cell said electrolyzing current is direct electrolyzing current applied across the anode and cathode of the cell and, in electrolyzing said two-compartment cell, any halide impurity in the chromate solution is reduced with commensurate evolution of halogen at the anode.

8. The process of claim 1 further characterized by introducing carbon dioxide into the catholyte of at least one of said electrolytic cells, or into catholyte being recirculated outside at least one of said electrolytic cells, thereby preparing carbonate product in the catholyte, and the carbonate product is removed from the cathode compartment or from recirculating catholyte.

9. The process of claim 1 wherein said dichromate solution introduced to the cell in step (F) is at a temperature within the range from about 15° C. to about 95° C. and a pressure differential enhances solution flow in step (G) from said center compartment through said porous diaphragm.

10. The process of claim 1 wherein for each cell said electrolyzing current provides a current density of above 0 to about 10 amperes per square inch and the electrolyzed anolyte solution of step (K) is at a temperature within the range from about 40° C. to about boiling.

11. The process of claim 1 further characterized by introducing in step (A) alkali metal chromate containing metallic ion impurity to said two-compartment electrolytic cell and reducing said impurity content in solution by attracting said impurity to the cation-exchange membrane of said cell.

12. The process of claim 1 further characterized by withdrawing electrolyzed anolyte solution from said two-compartment cell, and feeding same to evaporator means, thereby preparing a concentrated alkali metal dichromate solution, and in step (F) introducing said concentrated alkali metal dichromate solution from said evaporator means to the center compartment of the three-compartment electrolytic cell.

13. The process of claim 1 wherein at least a portion of said alkali product is recycled for use in chrome ore roasting.

14. The process of claim 1 wherein the alkali product concentration in the cathode compartment of each cell is at least partially controlled during electrolysis by water addition thereto or by water addition to catholyte being recirculated outside the cell.

15. The process of claim 1 wherein the alkali metal dichromate solution introduced to the cell in step (F) is substantially free from chromic acid.

16. The process of claim 1 wherein a hydrostatic head of pressure is present on said center compartment solution of the three-compartment electrolytic cell, and said pressure is maintained within the range from above 0 psig to about 2 psig.

17. The process of claim 1 further characterized by maintaining in the anode compartment of said three-compartment electrolytic cell aqueous sodium-dichromate-containing anolyte having an anolyte ratio between about 3 and 20.8 percent.

18. The process of claim 1 further characterized by maintaining in the anode compartment of said three-compartment electrolytic cell aqueous potassium-dichromate-containing anolyte having an anolyte ratio below 31.95 percent.

19. In the process of producing chromic acid from chrome ore wherein the ore is roasted, solids are removed, and processing provides intermediate alkali metal chromate, the improvement which comprises:

(A) introducing alkali metal chromate to the center compartment of a first three-compartment electrolytic cell, said chromate containing reduced forms of chromium, if such exist, at substantially below about 2 percent of the dichromate hexavalent chromium, said center compartment having porous diaphragm means separating same from an anode compartment and further having substantially hydraulically impermeable cation-exchange membrane means separating said center compartment from the cathode compartment;

(B) permitting center compartment solution flow through said porous diaphragm to the anode compartment;

(C) introducing electrolyte to said cathode compartment;

(D) applying electrolyzing current to said electrolytic cell;

(E) withdrawing from said cathode compartment electrolyzed catholyte solution containing alkali product;

(F) withdrawing from said anolyte compartment electrolyzed anolyte solution containing alkali metal dichromate;

(G) introducing alkali metal dichromate solution to the center compartment of a second three-component electrolytic cell, said center compartment having porous diaphragm means separating same from an anode compartment and further having substantially hydraulically impermeable cation-exchange membrane means separating said center compartment from the cathode compartment;

(H) permitting center compartment solution in step (G) to flow through said porous diaphragm to the anode compartment;

(I) introducing electrolyte to said cathode compartment of said second electrolytic cell;

(J) applying electrolyzing current to said second electrolytic cell;

(K) withdrawing electrolyzed catholyte solution containing alkali product from said cathode compartment in step (G); and (L) withdrawing electrolyzed anolyte solution containing chromic acid from said anode compartment of the second three-compartment cell for downstream recovery of chromic acid.

20. The process of claim 19 further characterized by withdrawing cell solution, depleted in alkali metal dichromate, from the center compartment of said second three-compartment cell and recycling same to combine with alkali metal dichromate feed introduced in step (G).

21. The process of claim 20 further characterized by passing at least a portion of said withdrawn cell solution to a mix tank.

22. The process of claim 21 wherein at least a portion of electrolyzed cathode solution is fed to said mix tank.

23. The process of claim 21 further characterized by crystallizing chromic acid crystals, in the downstream recovery of chromic acid, and introducing chromic-acid-containing liquor separated from said crystals into said mix tank.

24. The process of claims 21, 22 or 23 wherein solution is withdrawn from said mix tank and introduced in step (G) to said second three-compartment electrolytic cell.

25. The process of claim 19 wherein for each electrolytic cell said electrolyzing current is direct electrolyzing current applied across the anode and cathode of the cell and, in electrolyzing said first three-compartment cell, any halide impurity in the chromate solution is reduced with commensurate evolution of halogen at the anode.

26. The process of claim 19 further characterized by introducing carbon dioxide into the catholyte of at least one of said electrolytic cells, or into catholyte being recirculated outside at least one of said electrolytic cells, thereby preparing carbonate product in the catholyte, and the carbonate product is removed from the cathode compartment or from recirculating catholyte.

27. The process of claim 19 wherein a pressure differential in each cell enhances solution flow in each of steps (B) and (H) from said center compartment through said porous diaphragm.

28. The process of claim 19 wherein for each cell said electrolyzing current provides a current density of above 0 to about 10 amperes per square inch.

29. The process of claim 19 further characterized by introducing in step (A) alkali metal chromate containing metallic ion impurity to said first three-compartment electrolytic cell and reducing said impurity content in solution by attracting said impurity to the cation-exchange membrane of said cell.

30. The process of claim 19 further characterized in step (F) by withdrawing electrolyzed anolyte solution from said first three-compartment cell, and feeding same to evaporator means, thereby preparing a concentrated alkali metal dichromate solution, and introducing in step (G) said concentrated alkali metal dichromate solution from said evaporator means to the center compartment of the second three-compartment electrolytic cell.

31. The process of claim 19 wherein at least a portion of said alkali product is recycled for use in chrome ore roasting.

32. The process of claim 19 further characterized by withdrawing cell solution, depleted in alkali metal chromate, from the center compartment of said first electrolytic cell and recycling same to combine with alkali metal chromate feed introduced in step (A).

33. The process of claim 19 wherein the alkali product concentration in the cathode compartment of each cell is at least partially controlled during electrolysis by water addition thereto or by water addition to catholyte being recirculated outside the cell.

34. The process of claim 19 wherein the alkali metal dichromate solution introduced to the cell in step (G) is substantially free from chromic acid.

35. The process of claim 19 wherein a hydrostatic head of pressure is present on the center compartment solution for each electrolytic cell, and said pressure is maintained within the range from above 0 psig to about 2 psig.

36. The process of claim 19 further characterized by maintaining in the anode compartment of said second three-compartment electrolytic cell aqueous sodium-dichromate-containing anolyte having an anolyte ratio between about 3 and 20.8 percent.

37. The process of claim 19 further characterized by maintaining in the anode compartment of said second three-compartment electrolytic cell aqueous potassium-dichromate-containing anolyte having an anolyte ratio below 31.95 percent.

* * * * *